United States Patent [19]

Engman

[11] 4,337,748

[45] Jul. 6, 1982

[54] INTERNAL COMBUSTION ENGINE

[75] Inventor: Thomas O. J. Engman, Mullsjö, Sweden

[73] Assignee: Husqvarna Aktiebolag, Huskvarna, Sweden

[21] Appl. No.: 139,333

[22] Filed: Apr. 11, 1980

[30] Foreign Application Priority Data

Apr. 11, 1979 [SE] Sweden ..... 7903213

[51] Int. Cl.[3] ..... F02P 5/02

[52] U.S. Cl. ..... 123/602; 123/406; 123/149 C; 417/380

[58] Field of Search ..... 123/602, 599, 601, 406, 123/182, 149 C; 417/380

[56] References Cited

U.S. PATENT DOCUMENTS

| | | | |
|---|---|---|---|
| 1,901,846 | 3/1933 | Klaiber | 123/406 |
| 2,027,692 | 1/1936 | Klaiber | 123/149 C |
| 3,661,132 | 5/1972 | Farr | 123/602 |
| 3,886,916 | 6/1975 | Henderson | 123/602 |
| 4,013,050 | 3/1977 | Lace | 123/406 |
| 4,222,549 | 9/1980 | Lindgren | 417/380 |

FOREIGN PATENT DOCUMENTS

| | | | |
|---|---|---|---|
| 177354 | 8/1935 | Switzerland | 123/406 |

*Primary Examiner*—Charles J. Myhre
*Assistant Examiner*—Andrew M. Dolinar
*Attorney, Agent, or Firm*—Alfred E. Miller

[57] ABSTRACT

An internal combustion engine has a pressure discharge opening in the cylinder in order to enable use of the engine as a pneumatic power source as well as a mechanical power source. A valve is provided for the opening. The electric ignition system is arranged to enable ignition in the engine at a time suitable for mechanical power output, and, alternatively, at a time at which the pressure in the cylinder is substantially higher, for use as a pressure source.

6 Claims, 6 Drawing Figures

Fig. 4.
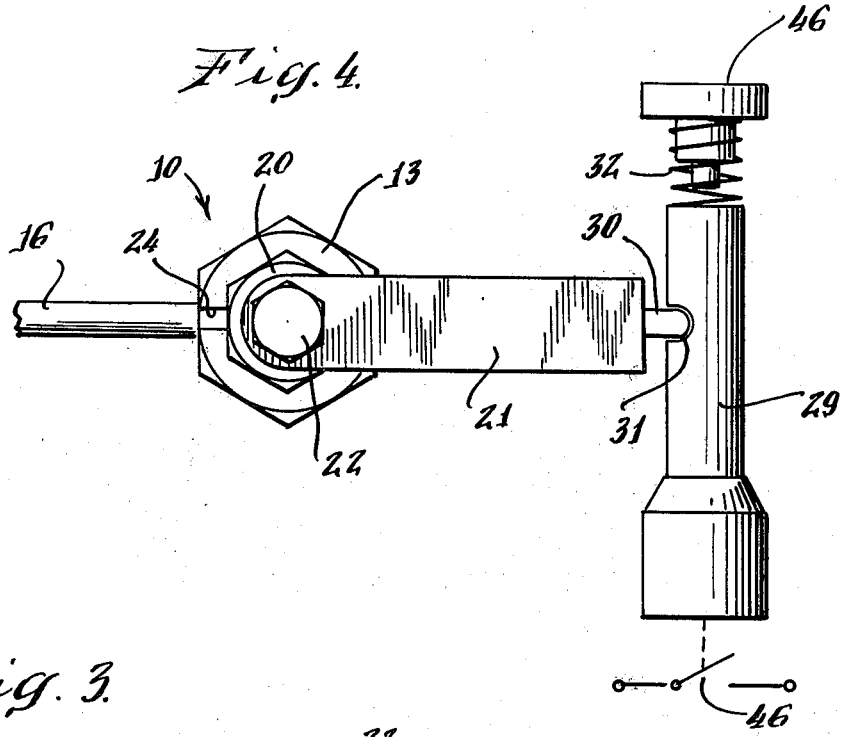
Fig. 3.
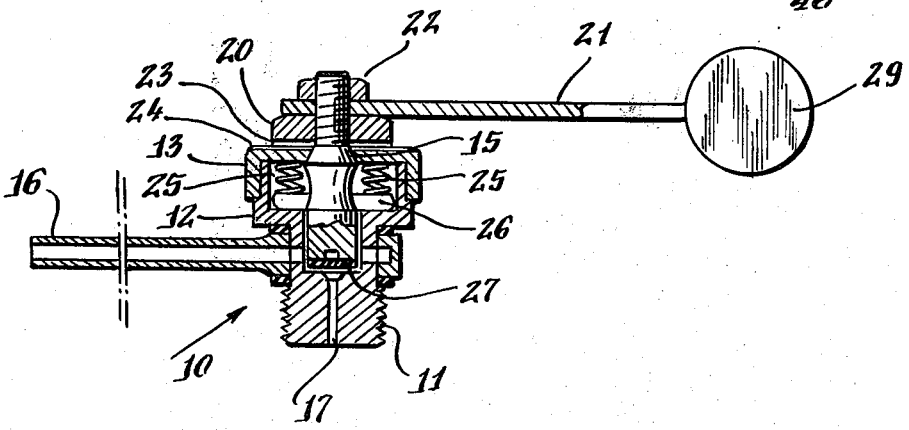
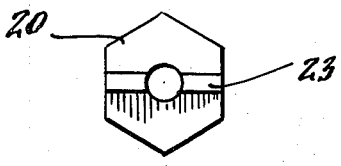
Fig. 5.
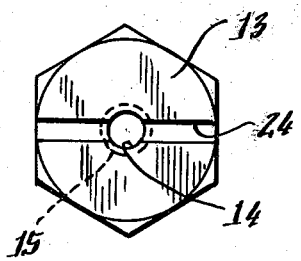
Fig. 6.

INTERNAL COMBUSTION ENGINE

This invention relates to an arrangement enabling pressure discharge in an i.c. engine, by means of a valve positioned in the cylinder wall and an ignition control device for controlling the ignition timing.

In the art of internal combustion engines it is known to provide a pressure discharge on the cylinder of the engine, and, by means of a tube, to supply a tool with pressure gas therefrom to the tool. Such an arrangement is described in Swedish patent publication No. 391 109. Devices employing this principle can be used for pressure systems supplying a comparatively low pressure, but are not useful for pressure systems supplying high pressures. The present invention is directed to an improvement in arrangements of this type, so that high pressure systems may also be employed.

According to the invention, an ignition control device is provided, for enabling another time of ignition in addition to the usual one for the engine. This extra ignition time is much in advance of the top dead center of the piston during the compression stroke of the engine and results in a much higher explosion pressure in the cylinder than when ordinary or conventional time of ignition is used. This higher pressure is useful to the driven tool via the pressure discharge. This may be expressed in a simplified way so that, by use of this advanced time of ignition, the engine constitutes a pneumatic power source, while the use of the ordinary time of ignition enables use of the engine as a mechanical power source. The possibility of these two applications of one and the same engine is obtained due to the provision of the discharge and an ignition control device according to the invention.

In order that the invention will be more clearly understood, it will now be disclosed in greater detail, with reference to the accompanying drawings:

FIG. 3 is a cross sectional view of a valve for the discharge outlet of the engine, in accordance with the invention;

FIG. 4 is top view of the valve of FIG. 3;

FIG. 5 is a bottom view of a washer employed in the valve of FIG. 3; and

FIG. 6 is a top view of a nut employed in the valve of FIG. 3.

Figure 2:
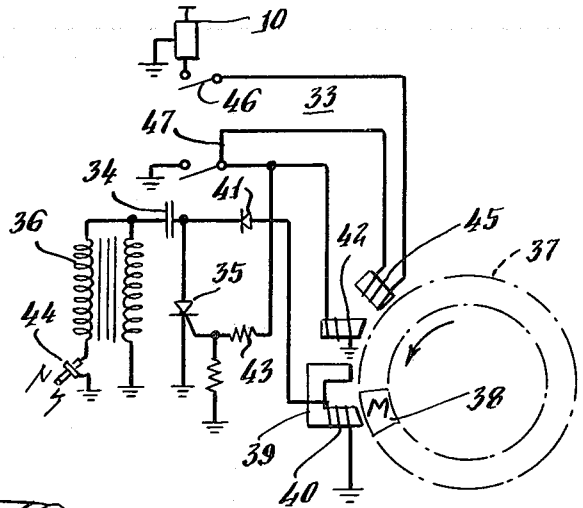
FIG. 2 is a circuit diagram of the ignition system of an internal combustion engine, in accordance with the invention.

The details of the discharge valve are shown in FIG. 3. A valve housing 10 has a threaded base 11, which fits in a threaded hole in the head of an internal combustion engine. The upper portion 12 of the housing is also threaded and forms a socket for a nut 13. A hole 14 is provided in the center of nut 13 (FIG. 6) and a seat 15 having bevelled edges surrounds the hole 14. A tube 16 is provided in the middle of the housing, to which a tool can be connected to be driven by means of gas. Further, the base 11 has a central passage 17, terminated at its upper end by a seat 18.

A valve body 19 is rotatably and axially displaceably arranged in the housing. Its upper portion is threaded and forms a socket for a guiding washer 20, a crank 21 and a locking nut 22. The guiding washer 20 has a diametrically extending cam 23 (FIG. 5), which fits in a likewise diametrically extending groove 24 (FIG. 6) of the nut 13. When the groove and the cam coincide the washer is close to the nut 13 and the valve body is hence positioned at its lower axial position. By turning the crank 21, the cam is forced out of the groove and the washer is raised somewhat above the nut, whereby the valve body 19 is forced into its upper axial position. Due to the use of this cam gear, the valve body 19 can rapidly be shifted from the one axial position to the other.

Elastic members 25, e.g. cup springs, are positioned in the valve housing between the inside of the nut 13 and a washer 26 located on the valve body. These members urge the valve body 19 to its lower position, when the cam and the groove coincide. They are somewhat compressed when the cam gear raises the valve body to its upper position. At the lower end of the valve body 19 a sealing washer 27 is inserted and pressed agasint the seat 18 by the end surface of the body when the cam and groove coincide. At this time the passage 17 is closed due to the pressure of the elastic members 25, which exceeds the pressure within the passage resulting from combustion in the engine.

In the embodiment shown the upper half of the valve body has a conical portion 28, which is tightly held in the similarly shaped seat 15, when the body is in its upper axial position. At this time a way is open from the passage 17 to the tube 16 by way of washer 27. Combustion gases will then be conducted to the tool connected to the tube 16. When, after use of the tool, the gas accumulated therein must be emptied, the crank is turned so that an evacuation path is opened from the tube 16 to the hole 14 in the nut 13, this hole then forming an outlet.

As a complement to the operating members a push rod 29 may be connected to the crank by means of a lug 30 in a recess 31 in the rod. One end of the rod is preferably equipped with a push-button, which is mounted to be readily accessible to the operator. The rod can be automatically returned by means of a spring 32, which serves to push it back. By means of the push rod it is also possible to operate an ignition presetting circuit 33 by means of this push rod, by using a conventional mechanical coupling connected between the push rod and switch 46.

FIG. 2 is a wiring diagram of a capacitor ignition circuit partly known per se. A capacitor 34 is connected in series with an SCR 35 and the primary winding 36 of an ignition coil. At least on permanent magnet 38 is mounted on the flywheel 37 of the engine. A U-shaped iron core 39 is passed by the permanent magnet during such revolution. One leg of the core has a coil 40 connected via a rectifier 41 to a point between the capacitor and the SCR. Each time the magnet passes the core, a current is fed from the coil to the capacitor to charge the capacitor. Another core has a triggering coil 42, which is connected to the control electrode of the SCR via a rectifier 43 and likewise emits a current each time the magnet passes by. This occurs at an ordinary time of ignition of the engine for maximum mechanical output, for use of the engine as a mechanical power source, and results in the discharge of the capacitor through the winding 36, and a spark in the spark plug 44.

The ignition presetting circuit 33 comprises a second triggering coil 45, which is connected by a wire 47 to the control electrode of the SCR via a contact 46. When the magnet passes this second triggering coil the spark is released in the spark plug, whereby the ignition occurs at an earlier time than when triggering by means of the coil 42.

A considerable increase in the combustion pressure is obtained if the time of ignition is changed to about 65° before top dead center of the piston. The ordinary time of ignition of a small two-stroke engine occurs at 22°-28° before top dead center. At 65°, preignition about doubles the pressure as compared with the pressure obtained by preignition in normal engine settings.

Figure 1:
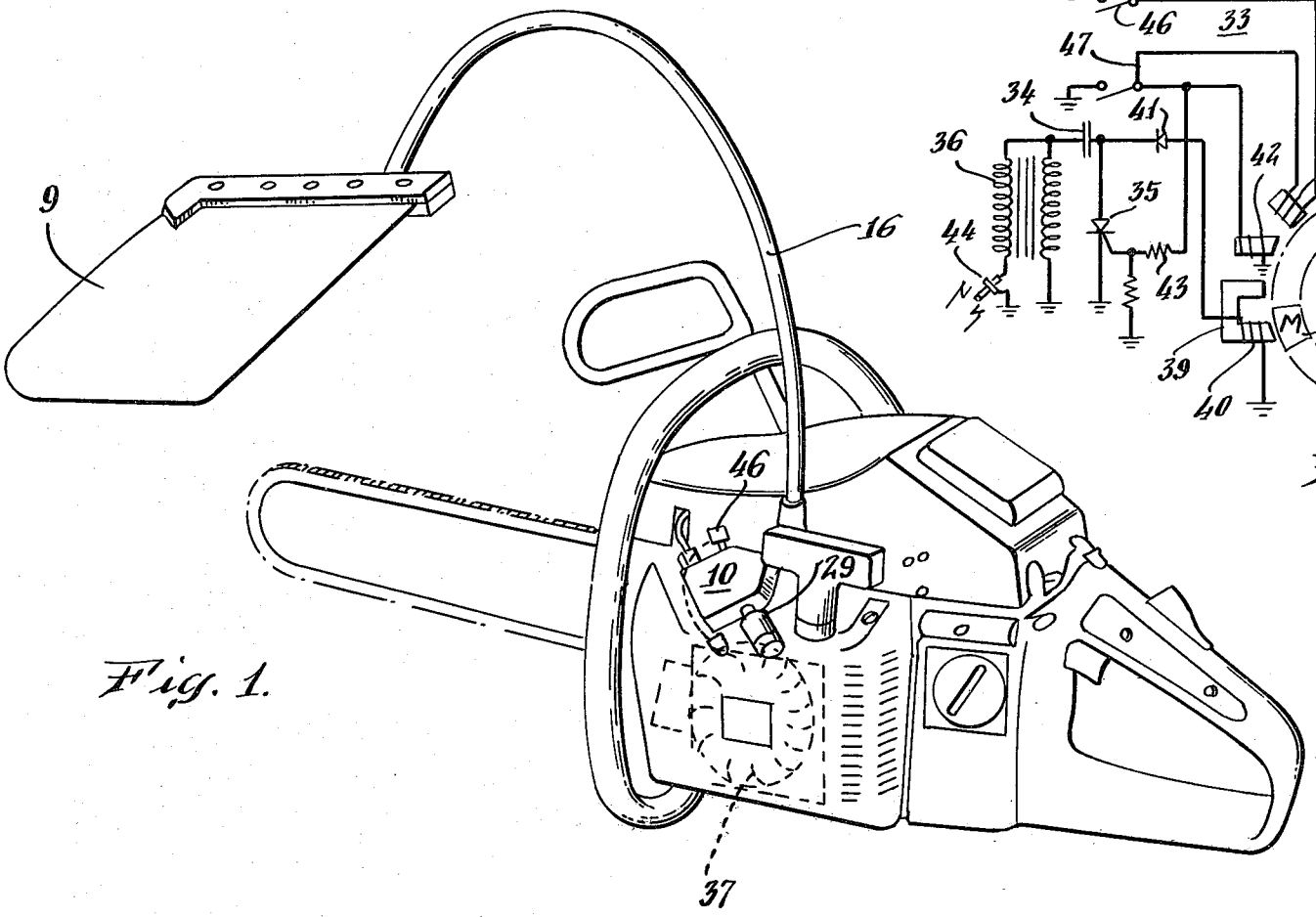
FIG. 1 is a perspective view of a power chain saw provided with an ignition control device and a valve connected to a tree felling cushion.

In order to decrease the stress on the engine, it is preferred that the discharge valve be opened before changing the preignition timing. In the embodiment shown, contact 46, which controls the ignition presetting circuit, is preferably not operated until the crank 21 is turned so as to open the passage 17 to the tube 16. When work with the tool, e.g. the tree felling cushion 9 of FIG. 1, is completed, the contact 46 is opened and then the discharge of gas is stopped by closing the valve.

When the push rod 29 is mechanically coupled to the switch 46, by conventional coupling means such as a lever, it is preferred that the coupling be arranged to open the valve before the switch is closed.

While the invention has been disclosed and described with reference to a single embodiment, it will be apparent that variations and modifications may be made therein. Thus, a number of alternatives for obtaining the desired preignition are possible, such as the use of mechanical switches arranged to provide the normal ignition timing and the greatly increased (before top dead center) timing as above discussed. It is therefore intended in the following claims to cover each such variation and modification as falls within the true spirit and scope of the invention.

What is claimed is:

1. In an internal combustion engine having a pressure discharge opening in a cylinder wall, and an electric ignition system having an ignition coil, a current source, and a spark release trigger means arranged to effect ignition in said engine at a time before top dead center during a compression stroke for producing maximum mechanical output from said engine, the improvement wherein said ignition system has an ignition presetting circuit with a second spark release trigger means positioned to provide a time of ignition earlier in the compression stroke of the engine than the time of ignition determined by said first-mentioned spark release trigger means, said second spark release trigger means being positioned to provide a substantially higher pressure at said discharge opening as compared with the pressure when ignition is determined by said first-mentioned spark release trigger means, and further comprising an operating valve in said discharge opening, and an operating switch connected to selectively energize said ignition presetting circuit.

2. The internal combustion engine of claim 1 wherein said engine is a two cycle engine, and said earlier time is at least about 65° before top dead center.

3. The internal combustion engine of claim 1 wherein said first and second spark release trigger means comprise a pair of spark release trigger coils for producing spark release trigger signals at different times before top dead center, one of which is set to said first mentioned time and the other of which is set to said earlier time, said operating switch being connected to select said spark trigger release coils.

4. The internal combustion engine of claim 1 wherein said valve has an outlet tube means, a first position at which said discharge opening is blocked and said tube is vented, and a second position at which said discharge opening is interconnected with said tube.

5. The internal combustion engine of claim 1 comprising common operating means coupled to operate said operating switch and said operating valve.

6. The internal combustion engine of claim 5 comprising means for delaying the operation of said switch in relation to the operation of said operating valve.

* * * * *